US011794478B2

(12) United States Patent
Shindo et al.

(10) Patent No.: US 11,794,478 B2
(45) Date of Patent: Oct. 24, 2023

(54) LIQUID EJECTION APPARATUS

(71) Applicant: BROTHER KOGYO KABUSHIKI KAISHA, Nagoya (JP)

(72) Inventors: Tatsuya Shindo, Nagoya (JP); Toshiro Ueda, Inazawa (JP); Ryuji Horata, Gamagori (JP); Zenichiro Sasaki, Nagoya (JP); Kenta Horade, Tokai (JP); Hironori Takasaki, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 7 days.

(21) Appl. No.: 17/582,082

(22) Filed: Jan. 24, 2022

(65) Prior Publication Data

US 2022/0234352 A1 Jul. 28, 2022

(30) Foreign Application Priority Data

Jan. 27, 2021 (JP) ..... 2021-011068

(51) Int. Cl.
*B41J 2/165* (2006.01)
*B41J 29/393* (2006.01)

(52) U.S. Cl.
CPC ..... *B41J 2/1652* (2013.01); *B41J 2/16579* (2013.01); *B41J 2002/16573* (2013.01)

(58) Field of Classification Search
CPC ..... B41J 2/165; B41J 2/0451; B41J 2/16579; B41J 2/2142; B41J 29/393
See application file for complete search history.

(56) References Cited

U.S. PATENT DOCUMENTS

2004/0155918 A1* 8/2004 Shimamura ..... B41J 2/16517 347/19
2007/0139461 A1 6/2007 Izuo
2009/0085940 A1* 4/2009 Hayakawa ..... B41J 2/16526 347/6
2009/0085956 A1* 4/2009 Shindo ..... B41J 2/17596 347/19

(Continued)

FOREIGN PATENT DOCUMENTS

JP 2007-152889 A 6/2007
JP 2007-261130 A 10/2007

(Continued)

*Primary Examiner* — Julian D Huffman
(74) *Attorney, Agent, or Firm* — Scully, Scott, Murphy & Presser, PC

(57) ABSTRACT

A liquid ejection apparatus includes a liquid ejection head having a plurality of nozzles, a determination circuit, a clock, and a controller. The controller is configured to determine whether the clock is in an on or off state. In response to determining that the clock is in an on state, the controller is configured to perform an inspection process at a first time. In the inspection process, the controller drives the liquid ejection head to eject liquid from a nozzle of the plurality nozzles and receive a determination signal that is output from the determination circuit in response to ejection of liquid from the nozzle of the plurality of nozzles. In response to determining that the clock is in an off state, the controller is configured to perform the inspection process at a predetermined time that is a time after the clock is returned to an on state.

14 Claims, 11 Drawing Sheets

(56) References Cited

U.S. PATENT DOCUMENTS

| | | | | |
|---|---|---|---|---|
| 2011/0242207 | A1* | 10/2011 | Nakazawa | B41J 2/17509 347/30 |
| 2014/0300657 | A1 | 10/2014 | Ike | |
| 2017/0259573 | A1* | 9/2017 | Iida | B41J 2/16532 |
| 2018/0147842 | A1* | 5/2018 | Horade | B41J 2/04573 |
| 2018/0207941 | A1* | 7/2018 | Horade | B41J 29/13 |
| 2018/0215155 | A1* | 8/2018 | Iida | B41J 2/1652 |

FOREIGN PATENT DOCUMENTS

| | | | |
|---|---|---|---|
| JP | 2014-61673 | A | 4/2014 |
| JP | 2014-200982 | A | 10/2014 |

* cited by examiner

LIQUID EJECTION APPARATUS

CROSS-REFERENCE TO RELATED APPLICATION

This application claims priority from Japanese Patent Application No. 2021-011068 filed on Jan. 27, 2021, the content of which is incorporated herein by reference in its entirety.

TECHNICAL FIELD

Aspects of the disclosure relate to a liquid ejection apparatus that ejects liquid from nozzles.

BACKGROUND

Examples of a known liquid ejection apparatus that ejects liquid from nozzles include a printer that records images by ejecting ink from nozzles. The known printer drives a pump at a predetermined time appointed in advance to apply pressure, performing a maintenance operation including purging for forcibly discharging ink from a head.

SUMMARY

According to an aspect of the disclosure, a liquid ejection apparatus includes a liquid ejection head having a plurality of nozzles, a determination circuit, a clock, and a controller. The determination circuit is configured to output a determination signal in response to ejection of liquid from a nozzle of the plurality of nozzles. The determination signal indicates whether the nozzle is a defective nozzle. The controller is configured to determine whether the clock is in an on or off state. In response to determining that the clock is in an on state, the controller is configured to perform an inspection process at a first time. In the inspection process, the controller is configured to drive the liquid ejection head to eject liquid from the nozzle of the plurality nozzles and receive a determination signal that is output from the determination circuit in response to ejection of liquid from the nozzle of the plurality of nozzles. In response to determining that the clock is in an off state, the controller is configured to perform the inspection process at a predetermined time that is a time after the clock is returned to an on state.

DETAILED DESCRIPTION

In the known printer described above, the maintenance operation is performed at a predetermined time. However, when the printer is not powered, that is, when the plug is disconnected and a built-in battery runs out, its internal clock does not keep time. Hereinafter, this state will be referred to as that "the clock is in an off state". In this case, even if the plug is inserted and the power supply to the printer is resumed thereafter, the clock cannot keep accurate time, and the maintenance operation cannot be performed at an appropriate time.

To solve the above problem, it is an object of the disclosure to provide a liquid ejection apparatus configured to perform a maintenance operation appropriately even when a clock is in an off state.

Hereinafter, an illustrative embodiment will be described with reference to the accompanying drawings.

General Configuration of Printer

Figure 1:
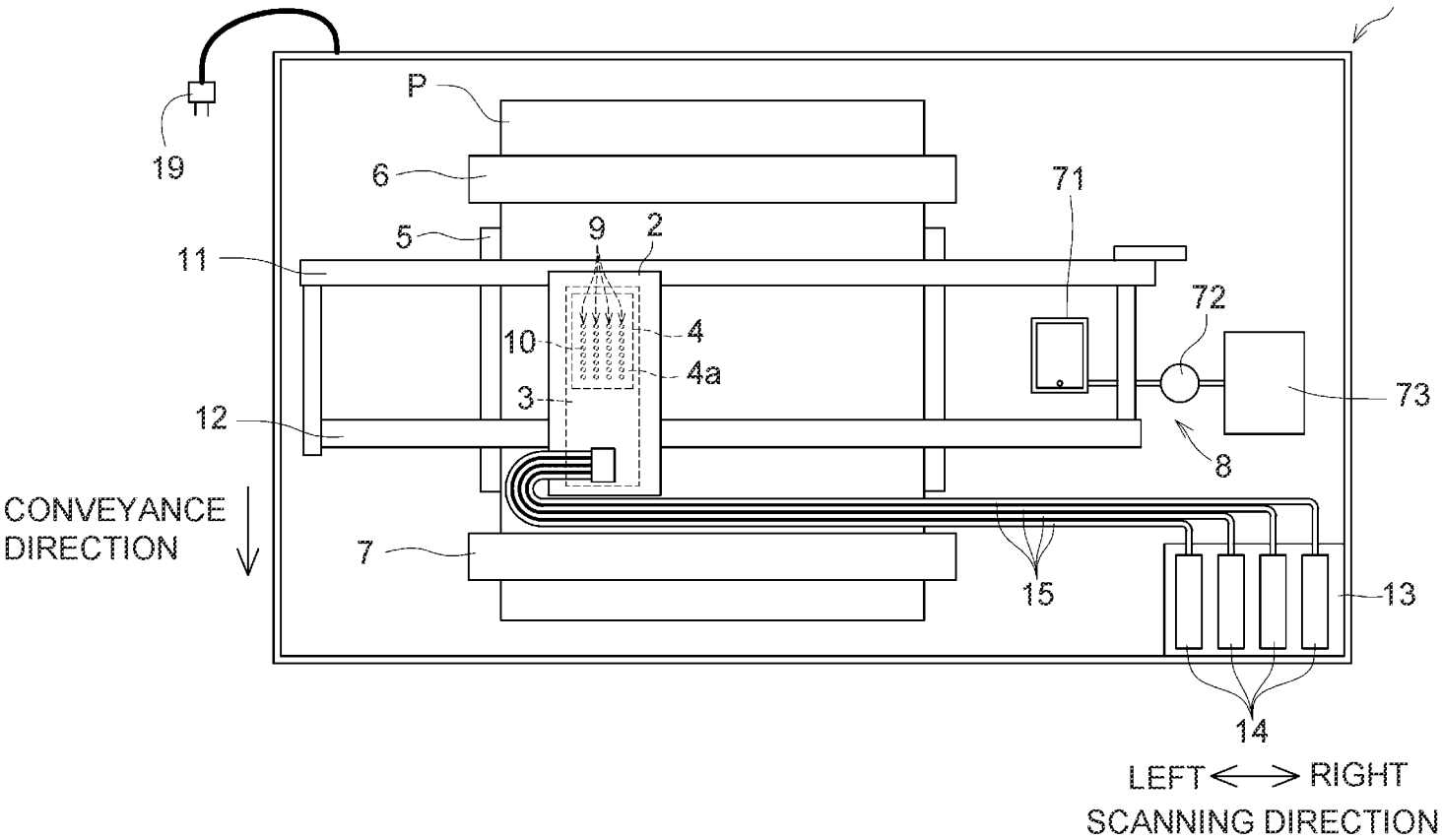
FIG. 1 is a schematic diagram illustrating a general configuration of a printer according to an illustrative embodiment.

As illustrated in FIG. 1, a printer 1 as an example of a liquid ejection apparatus includes a carriage 2, a sub tank 3, an inkjet head 4 as an example of a liquid ejection head, a platen 5, conveyance rollers 6 and 7, a maintenance unit 8, and a plug 19.

The carriage 2 is supported by two guide rails 11 and 12 each extending in a scanning direction (e.g., a right-left direction). The carriage 2 is configured to reciprocate in the scanning direction along the guide rails 11 and 12. The carriage 2 is connected to a carriage motor 86 (in FIG. 4) via a belt. In response to the carriage motor 86 being driven, the carriage 2 moves in the scanning direction along the guide rails 11 and 12. The scanning direction corresponds to a right-left direction as illustrated in FIG. 1.

The sub tank 3 is mounted on the carriage 2. The printer 1 further includes a cartridge holder 13. The cartridge holder 13 accommodates a plurality of, for example, four, ink cartridges 14 that are detachable. The four ink cartridges 14 arranged in the scanning direction store ink (as an example of liquid) of different colors, from right to left, black, yellow, cyan, and magenta, respectively. The sub tank 3 is connected via four tubes 15 to the four ink cartridges 14 attached to the cartridge holder 13. Such a configuration thus enables supply of ink of the four colors to the sub tank 3 from the four ink cartridges 14.

The inkjet head 4 is mounted on the carriage 2 and connected to a lower end of the sub tank 3. The inkjet head 4 is supplied with ink of the four colors from the sub tank 3. The inkjet head 4 has an array of nozzles 10 defined in a nozzle surface 4*a* that is its lower surface. The inkjet head 4 is configured to eject ink from the nozzles 10. Specifically, for example, the nozzles 10 are arranged in rows extending in a conveyance direction orthogonal to the scanning direction to form nozzle rows 9. The nozzle surface 4*a* has a plurality of, for example, four, nozzle rows 9 next to each other in the scanning direction. In the inkjet head 4, black ink is ejected from the nozzles 10 constituting the rightmost nozzle row 9 in the scanning direction. Yellow ink is ejected from the nozzles 10 constituting the nozzle row 9 to the left of the black nozzle row 9. Cyan ink is ejected from the nozzles 10 constituting the nozzle row 9 to the left of the yellow nozzle row 9. Magenta ink is ejected from the nozzles 10 constituting the nozzle row 9 to the left of the cyan nozzle row 9.

The platen 5 is disposed below the inkjet head 4 and faces the nozzles 10. The platen 5 extends in the scanning direction to have a dimension covering the entire width of a recording sheet P to be conveyed. The recording sheet P is an example of a recording medium. The platen 5 is configured to support from below a recording sheet P being conveyed. The conveyance roller 6 is disposed upstream of the inkjet head 4 and the platen 5 in the conveyance direction. The conveyance roller 7 is disposed downstream of the inkjet head 4 and the platen 5 in the conveyance direction. The conveyance rollers 6 and 7 are connected to a conveyance motor 87 (in FIG. 4) via gears. In response to the conveyance motor 87 being driven, the conveyance rollers 6 and 7 rotate to convey a recording sheet P in the conveyance direction.

The maintenance unit 8 includes a cap 71, a suction pump 72, and a waste liquid tank 73. The cap 71 is disposed to the right of the platen 5 in the scanning direction. When the carriage 2 is located in a maintenance position, the nozzles 10 face the cap 71. The maintenance position is further to the right than the platen 5 in the scanning direction.

Figure 4:
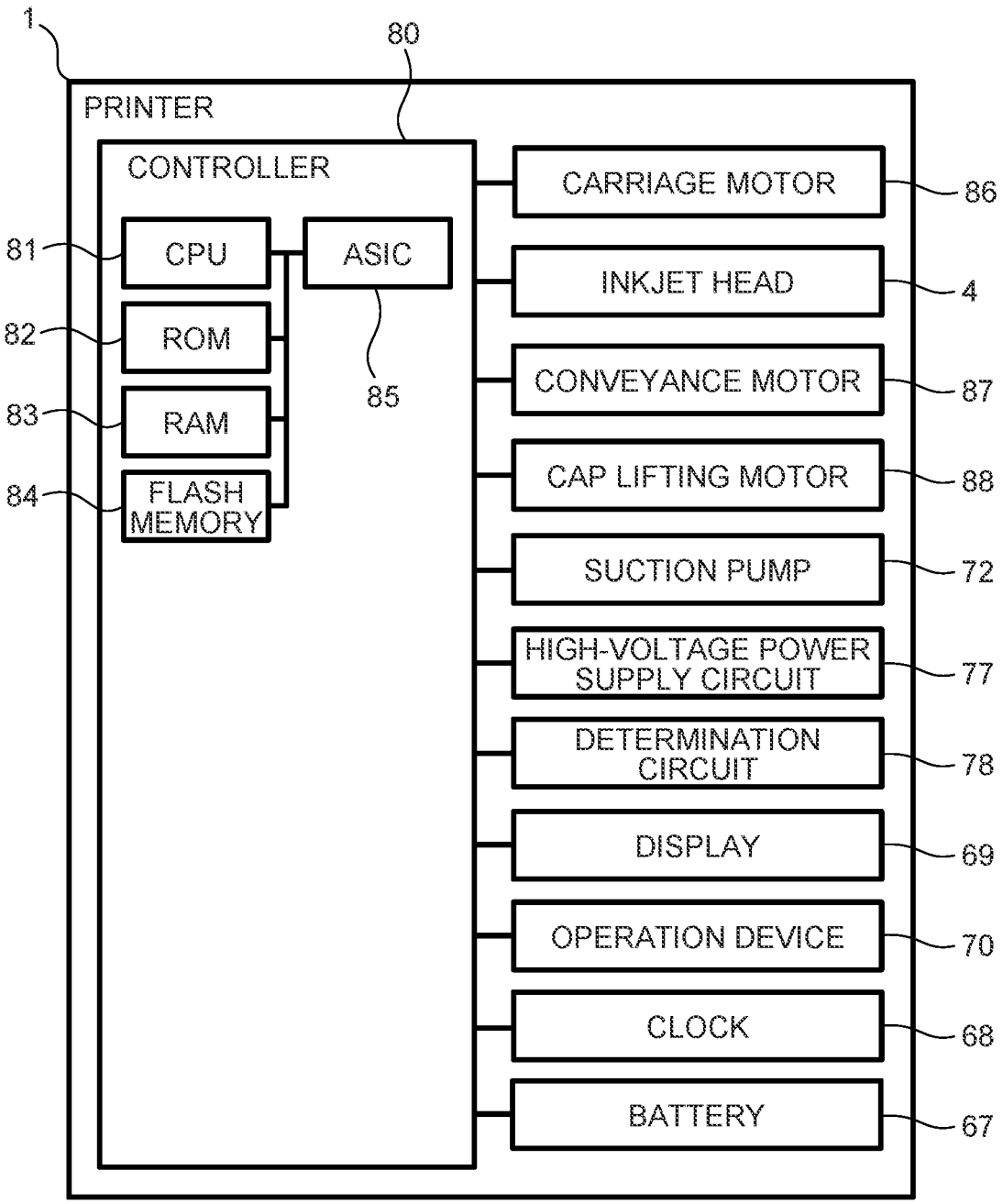
FIG. 4 is a block diagram illustrating an electrical configuration of the printer.

The cap 71 is movable upward and downward selectively by control of a cap up-and-down mechanism 88 (in FIG. 4). The carriage 2 is moved to stop at the maintenance position so that the nozzles 10 and the cap 71 face each other. In such a state, in response to the cap 71 being moved upward by the cap up-and-down mechanism 88, an upper end of the cap 71 fully contacts the nozzle surface 4*a* of the inkjet head 4 to cover the nozzles 10. At this time, the cap 71 that covers the nozzles 10 is in a capping state, and the nozzles 10 capped by the cap 71 are in a capped state. The cap 71 is not limited to have such a configuration that the upper end fully contacts the nozzle surface 4*a* to cover the nozzles 10. The cap 71 may be structured such that that the upper end fully contacts a frame surrounding the nozzle surface 4*a* of the inkjet head 4 to cover the nozzles 10.

The suction pump 72 may be a tube pump. The suction pump 72 is connected to the cap 71 and the waste liquid tank 73. The maintenance unit 8 uses the suction pump 72 to perform suction purging in which, in response to the suction pump 72 being driven with the nozzles 10 in the capped state, ink in the inkjet head 4 is pumped out or discharged from the nozzles 10. Ink discharged from the inkjet head 4 through suction purging is collected in the waste liquid tank 73.

For the sake of convenience, in this embodiment, the cap 71 covers all the nozzles 10 of the inkjet head 4 and suction purging is performed to discharge ink in the inkjet head 4 from all the nozzles 10. In some embodiments, the maintenance unit 8 may include a plurality of caps 71, one for covering the nozzles 10 constituting the rightmost nozzle row 9 from which black ink is discharged, and the other for covering the nozzles 10 constituting the remaining three nozzle rows 9 from which respective color inks (e.g., yellow, cyan, and magenta inks) are discharged. Such a configuration may enable suction purging to discharge black ink or color inks selectively in the inkjet head 4. Alternatively, for example, the maintenance unit 8 may include a plurality of caps 71 for respective nozzle rows 9. Such a configuration may enable ink to be discharged from the nozzles 10 of the inkjet head 4 on a nozzle row 9 basis.

Figure 2:
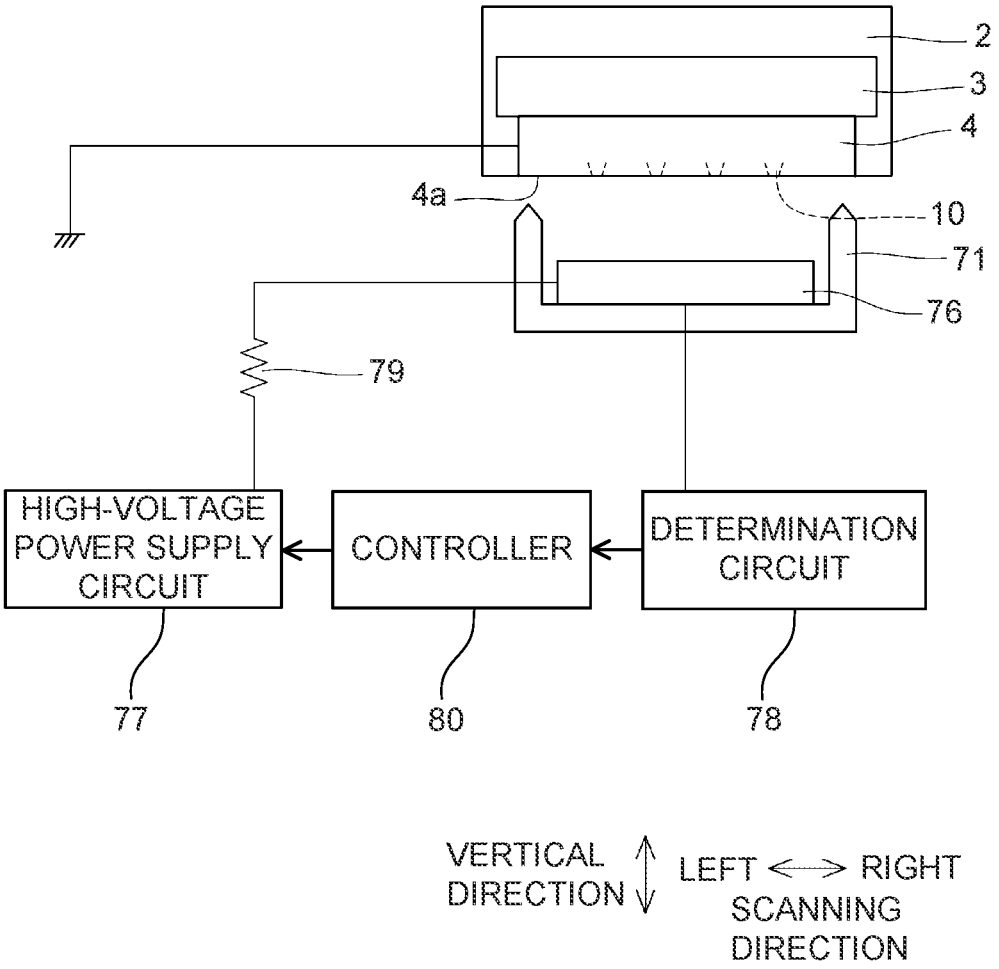
FIG. 2 illustrates a detection electrode disposed in a cap, a connection relationship between the detection electrode and a high-voltage power supply circuit, and a connection relationship between the detection electrode and a determination circuit.

As illustrated in FIG. 2, a detection electrode 76 having a rectangular planar shape is disposed within the cap 71. The detection electrode 76 is connected to a high-voltage power supply circuit 77 via a resistor 79. The detection electrode 76 receives a predetermined positive potential (e.g., 600 v) from the high-voltage power supply circuit 77 during an ejection determination process described later. In contrast, the inkjet head 4 is maintained at the ground potential. This causes a potential difference between the inkjet head 4 and the detection electrode 76. The detection electrode 76 is connected to a determination circuit 78. The determination circuit 78 compares a potential of a signal outputted from the detection electrode 76 with a threshold value Vt, and outputs a signal responsive to a comparison result.

Figure 3A:
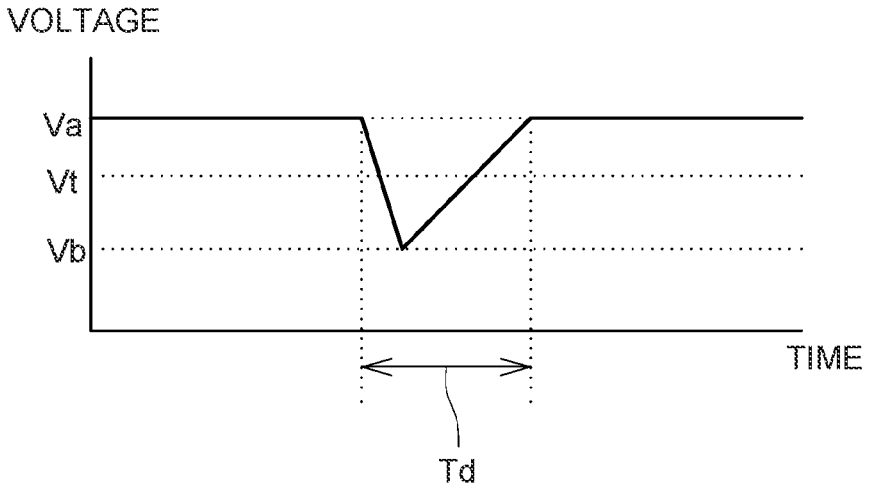
FIG. 3A is a graph showing changes in potential of the detection electrode in a case where ink has been ejected from a nozzle.

As the detection electrode 76 and the inkjet head 4 have a potential difference therebetween, ink becomes charged when ejected from the nozzles 10. When the carriage 2 is at the maintenance position, the inkjet head 4 is driven to eject ink from a nozzle 10 toward the detection electrode 76. As illustrated in FIG. 3A, until the charged ink approaches and reaches the detection electrode 76, the potential of the detection electrode 76 lowers from a potential Va at which the inkjet head 4 is not driven to eject ink, and reaches a potential Vb, which is lower than the potential Va. After the charged ink reaches the detection electrode 76, the potential of the detection electrode 76 gradually rises to the potential Va. In other words, the potential of the detection electrode 76 changes in a driving period Td during which the inkjet head 4 is driven to eject ink.

Figure 3B:
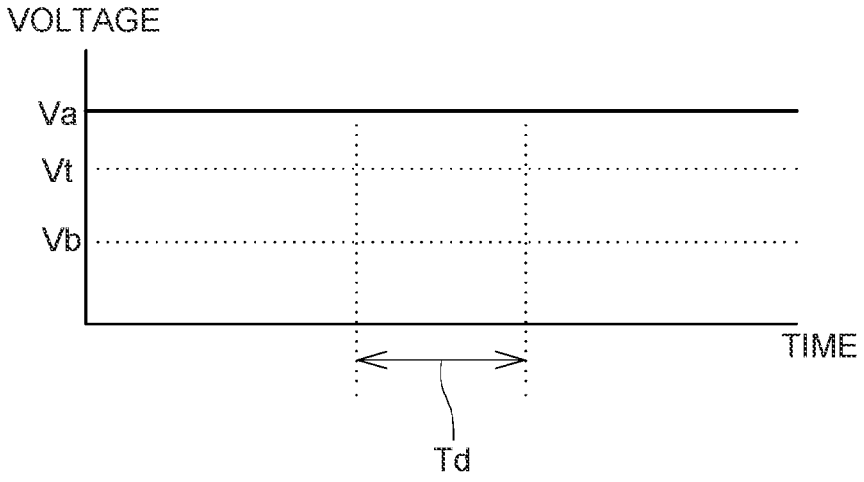
FIG. 3B is a graph showing no change in potential of the detection electrode in a case where ink has not been ejected from a nozzle.

In contrast, in a case where ink is not ejected from a nozzle 10 while the inkjet head 4 is driven, as illustrated in FIG. 3B, the potential of the detection electrode 76 does not change substantially from the potential Va in the driving period Td of the inkjet head 4, for example, less than the difference between Va and Vt. The determination circuit 78 uses the threshold value Vt satisfying an equation $Vb<Vt<Va$ to discriminate whether ink is ejected or not ejected from a nozzle 10. In the driving period Td of the inkjet head 4, the determination circuit 78 compares a maximum potential of a voltage signal outputted from the detection electrode 76 with a threshold value Vt, and outputs a determination signal responsive to a comparison result. In this embodiment, a combination of the detection electrode 76, the high-voltage power supply circuit 77, the resistor 79, and the determination circuit 78 is an example of a determination circuit. The determination circuit outputs a determination signal responsive to whether a nozzle 10 is a defective nozzle having an abnormal condition in ink ejection. Specifically, a defective nozzle in this case is a nozzle from which ink is not ejected.

The high-voltage power supply circuit 77 may apply a negative potential (e.g., −600 V) to the detection electrode 76 instead of a positive potential. In this case, when the carriage 2 is at the maintenance position and ink is ejected from a nozzle 10 toward the detection electrode 76, the potential of the detection electrode 76 rises from the potential Va until the charged ink approaches and reaches the detection electrode 76, and gradually lowers to the potential Va after the charged ink reaches the detection electrode 76.

The plug 19 is connectable to the electricity supply. The printer 1 is supplied with power from the plug 19 when the plug 19 is inserted in a wall outlet and connected to the electricity supply. When the plug 19 is disconnected from the electricity supply, the supply of power from the plug 19 is stopped.

Electrical Configuration of Printer

Hereinafter, a description will be provided on an electrical configuration of the printer 1. As illustrated in FIG. 4, the printer 1 includes a controller 80. The controller 80 includes a CPU 81, a ROM 82, a RAM 83, a flash memory 84, and an ASIC 85. The controller 80 controls the carriage motor 86, the inkjet head 4, the conveyance motor 87, the cap up-and-down mechanism 88, the suction pump 72, and the high-voltage power supply circuit 77. The controller 80 receives a determination signal from the determination circuit 78.

The printer 1 includes a display 69, an operation device 70, a clock 68, and a battery 67. The display 69 is, for example, a liquid crystal display provided in a housing of the printer 1. The controller 80 controls the display 69 to display information necessary for the operations of the printer 1. The operation device 70 includes buttons provided on the housing of the printer 1 and a touch screen provided on the display 69. When the user operates the operation device 70, a signal is input to the controller 80.

In this embodiment, the operation device 70 includes a power switch. The user operates the power switch to switch the power of the printer 1 on and off. When the user turns on the power of the printer 1 by operating the power switch of the operation device 70, the controller 80 receives a power-on signal (as an example of a "predetermined signal") from the operation device 70. The power-on signal indicates that the power of the printer 1 has been turned on. The clock 68 measures time, and the controller 80 receives a time signal indicating a time from the clock 68.

The battery 67 is connected to at least the controller 80 and the clock 68. While the printer 1 is supplied with power from the plug 19, the battery 67 is charged. When the printer 1 is not supplied with power from the plug 19, which is disconnected from the electricity supply, but the battery 67 is alive, the battery 67 supplies power to at least the controller 80 and the clock 68.

In the controller 80, only the CPU 81 or the ASIC 85 may perform all processing or a combination of the CPU 81 and the ASIC 85 may perform all processing. Alternatively, the controller 80 may include a single CPU 81 that may perform all processing or include a plurality of CPUs 81 that may share all processing. Alternatively, the controller 80 may include a single ASIC 85 that may perform all processing or include a plurality of ASICs 85 that may share all processing.

Processing During Power Supply from Plug or Battery

Next, a description will be given of processing performed when electric power is supplied from the plug 19 or the battery 67 to the control device 80 and the clock 68 in the printer 1.

Figure 5:
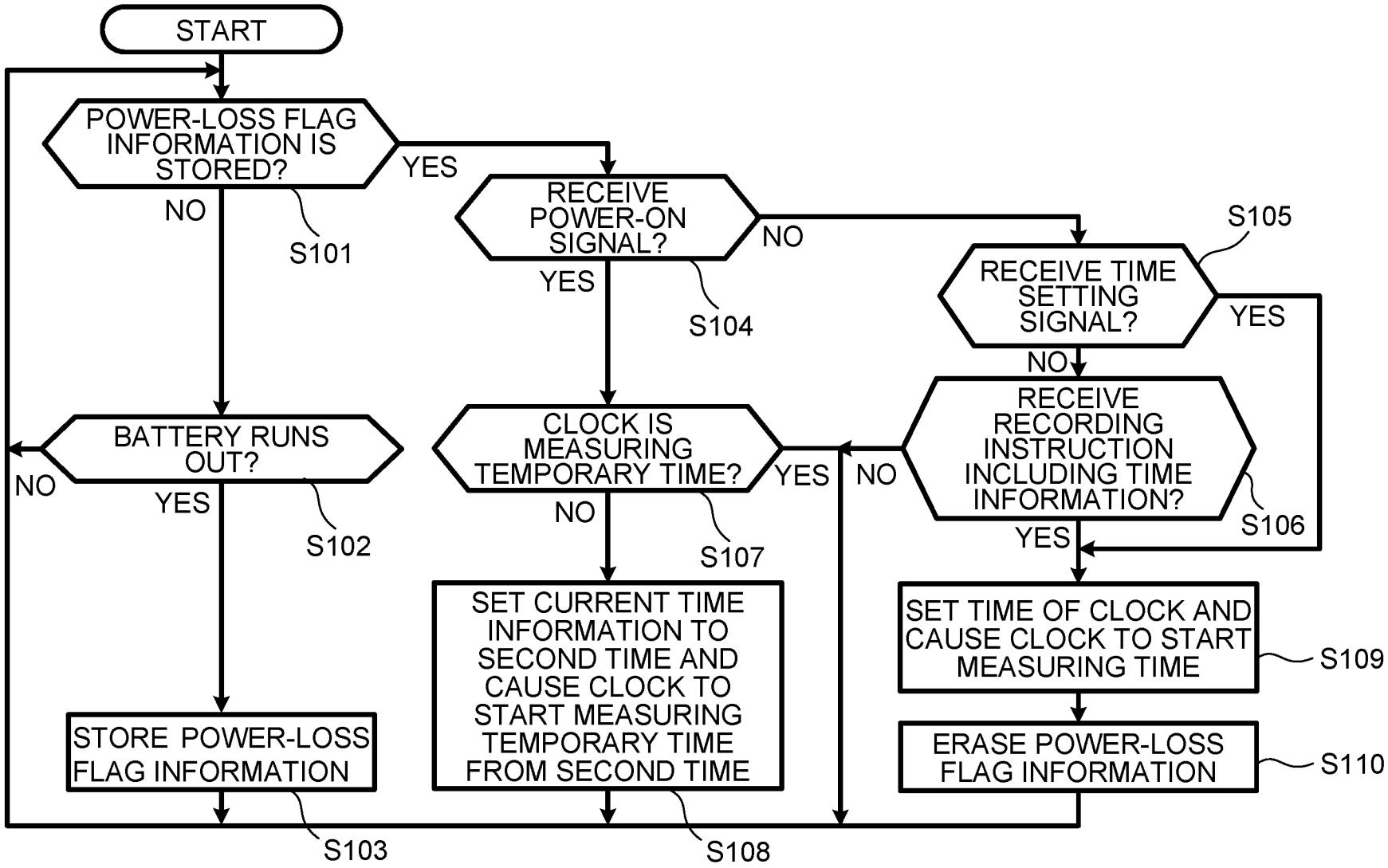
FIG. 5 is a flowchart of a process performed when power is supplied from a plug or a battery.

The controller 80 performs a process in accordance with the flowchart of FIG. 5. The process of FIG. 5 is started when the plug 19 is connected to the electricity supply, for example, with the battery 67 dead and power supply to the printer 1 is started. The process is repeated until the plug 19 is disconnected and the battery 67 runs out.

Specifically, as to the process of FIG. 5, the controller 80 determines whether power-loss flag information is stored in the flash memory 84 in S101. The flash memory 84 is as an example of storage. The power-loss flag information indicates that the clock 68 is in an off state because the power supply to the clock 68 is stopped due to the plug 19 being disconnected and the battery 67 running out.

In response to determining that the power-loss flag information is not stored in the flash memory 84 (S101: NO), the controller 80 determines whether the battery 67 runs out in S102. In S102, for example, when the plug 19 is removed and the state of charge of the battery 67 is less than a predetermined threshold value, the controller 80 determines that the battery 67 runs out. Further, in S102, for example, when the plug 19 is inserted and the state of charge of the battery 67 is equal to or higher than the predetermined threshold value, the controller 80 determines that the battery 67 does not run out or is alive.

When the controller 80 determines that the battery 67 does not run out or is alive (S102: NO), the process returns to S101. In response to determining that the battery 67 runs out (S102: YES), the controller 80 stores the power-loss flag information in the flash memory 84 in S103 and the process returns to S101.

In response to determining that the power-loss flag information is stored in the flash memory 84 (S101: YES), the controller 80 determines whether it has received a power-on signal, a time setting signal, or a recording instruction including the time information in S104, S105, and S106. If the controller 80 has received none of them (S104: NO, S105: NO, S106: NO), the process returns to S101.

The power-on signal is a signal that is input when the user operates the power switch of the operation device 70 or disconnects the plug 19 without turning off with the power switch and then reconnects the plug 19 with the power switch in the on position. The power-on signal is a signal and that indicates an instruction to turn the power of the printer 1 on. The time setting signal is a signal for setting a time that is input when the user operates the power switch of the operation device 70. The recording instruction including time information is, for example, a recording instruction including transmission time information input to the printer 1 from an external device such as a PC, which is connected to the printer 1.

In response to receipt of a power-on signal (S104: YES), the controller 80 determines whether the clock 68 is measuring a temporary time in S107. The clock 68 measuring a temporary time refers to a state where the clock 68 is working but measuring time different from the actual time.

When the controller 80 determines that the clock 68 is measuring a temporary time (S107: YES), the process returns to S101. In response to determining that the clock 68 is not measuring a temporary time (S107: NO), the controller 80 sets current time information to a second time and causes the clock 68 to start measuring the temporary time from the second time in S108, and the process returns to S101. The second time is time reset when the controller 80 receives the power-on signal, for example, 0:00. The second time is time for the controller 80 to perform an inspection process described later. The controller 80 determines the clock 68 as measuring the temporary time unless and until the controller 80 receives a time setting signal or a recording instruction including time information.

In response to receipt of a time setting signal (S105: YES) or a recording instruction including time information (S106: YES), the controller 80 sets the clock 68 to the time included in the time setting signal or the time information, and causes the clock 68 to start measuring time from the set time in S109. The controller 80 erases the power-loss flag information stored in the flash memory 84 in S110 and the process returns to S101.

Processing During Power Supply from Plug

Figure 6:
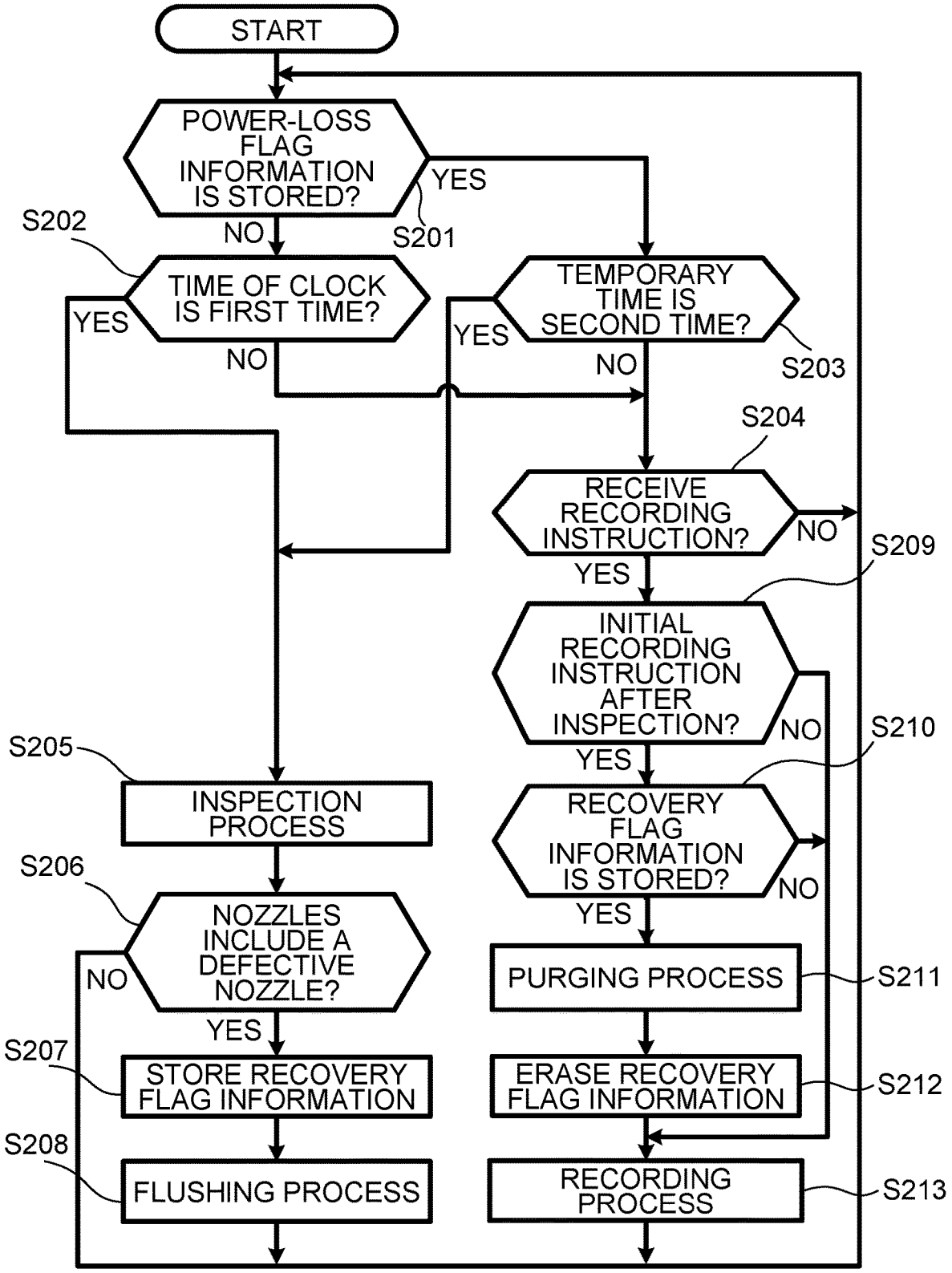
FIG. 6 is a flowchart of a process performed when power is supplied from the plug.

Next, a description will be given of processing performed when electric power is supplied from the plug 19. The controller 80 performs a process in accordance with the flowchart of FIG. 6. The process of FIG. 6 is started when the plug 19 is connected to the electricity supply. The process is repeated until the plug 19 is disconnected and the battery 68 runs out. When electric power is supplied from the plug 19, the controller 80 performs the process shown in the flowchart of FIG. 5 and the process shown in the flowchart of FIG. 6 in parallel.

Specifically, as to the process of FIG. 6, the controller 80 determines whether power-loss flag information is stored in the flash memory 84 in S201. In response to determining that the power-loss flag information is not stored in the flash memory 84 (S201: NO), the controller 80 determines whether the time the clock 68 indicates is a first time in S202. The first time is time for the controller 80 to perform the inspection process, and is stored in advance in the flash memory 84.

In response to determining that the power-loss flag information is stored in the flash memory 84 (S201: YES), the controller 80 determines whether the temporary time the clock 68 indicates is the second time in S203. In response to determining that, in S202, the time the clock 68 indicates is not the first time (S202: NO) and, in S203, the temporary time the clock 68 indicates is not the second time (S203: NO), the controller 80 determines whether it has received a recording instruction in S204. In response to the controller 80 not receiving the recording instruction (S204: NO), the process returns to S201.

In response to determining that the power-loss flag information is not stored in the flash memory 84 (S201: NO) and the time the clock 68 indicates is the first time (S202: YES), the controller 80 performs an inspection process in S205. In the inspection process, the controller 80 drives the inkjet head 4 to perform inspection driving to eject ink from each nozzle 10 sequentially. The controller 80 receives a determination signal output from the determination circuit 78 during the inspection driving.

The controller 80 determines whether the nozzles 10 of the inkjet head 4 include a defective nozzle in accordance with a determination signal received during the inspection process in S206. If the nozzles 10 do not include a defective nozzle (S206: NO), the process returns to S201.

In response to determining that the nozzles 10 include a defective nozzle (S206: YES), the controller 80 stores recovery flag information in the flash memory 84 in S207. The recovery flag information indicates a need to perform a recovery operation to discharge ink from the nozzles 10 to recover the defective nozzle. The controller 80 performs a flushing process in S208 and the process returns to S201. In the flushing process at S208, the controller 80 drives the inkjet head 4 to perform flushing to discharge ink from the nozzles. In this flushing, ink may be discharged from a defective nozzle only, or from at least a group of the nozzles 10 that are not defective in addition to the defective nozzle.

In response to determining that the power-loss flag information is stored in the flash memory 84 (S201: YES) and the time the clock 68 indicates is the second time (S203: YES), the controller 80 performs steps S205 to S208.

In response to receipt of the recording instruction (S204: YES), the controller 80 determines whether the received recording instruction is an initial recording instruction only after the inspection process is performed in S209. If the received recording instruction is not an initial recording instruction only after the inspection process is performed (S209: NO), the process proceeds to S213. In response to determination that the received recoding instruction is the initial recording instruction only after the inspection process is performed (S209: YES), the controller 80 determines whether the recovery flag information is stored in the flash memory 84 (S210). In response to determining that the recovery flag information is not stored in the flash memory 84 (S210: NO), the process proceeds to S213.

In response to determining that the recovery flag information is stored in the flash memory 84 (S210: YES), the controller 80 performs a purging process in S211, and erases the recovery flag information stored in the flash memory 84 in S212, and then the process proceeds to S213.

In S213, the controller 80 performs a recording process. In the recording process, the controller 80 controls the carriage motor 86 and the conveyance motor 87 to alternately perform a recording pass and a conveyance operation. In the recording pass, the inkjet head 4 ejects ink from the nozzles 10 toward a sheet P while the carriage 2 is moved in the scanning direction. In the conveyance operation, the conveyance rollers 6 and 7 convey the recording sheet P for a predetermined distance. After the recording process, the process returns to S201.

In this embodiment, the inkjet head 4 that performs flushing and the maintenance unit 8 that performs suction purging correspond to "recovery means". A combination of flushing and suction purging corresponds to the "recovery operation". In the combination, flushing corresponds to a part of the recovery operation, and suction purging corresponds to the remaining part of the recovery operation.

Effects

In this embodiment, in response to determining that the clock 68 is in an on state in which the clock 69 keeps actual time (in other words, the power-loss flag information is not stored in the flash memory 84), the controller performs the inspection process when the time the clock 68 indicates is the first time. This enables the liquid ejection apparatus to check whether the nozzles include a defective nozzle at a desired time, such as in a period of time during which the user is not using the liquid ejection apparatus. In response to determining that the clock 68 is in an off state, the controller sets time when the power is turned on to the second time, and causes the clock 68 to measure a temporary time from the second time. Thereafter, the controller 80 performs the inspection process every time the temporary time indicated by the clock 68 is the second time of next and subsequent days until the battery 67 runs out. This enables the controller 80 to perform the inspection process periodically even if the clock 68 has been switched to an off state.

In this embodiment, when the clock 68 returns from an off state to an on state, time to perform the inspection process is returned to time at which the time the clock 68 indicates is the first time. After the clock 68 returns to the on state, the inspection process can be performed at a timing desired by the user.

In this embodiment, the controller 80 stores the power-loss flag information in the flash memory 84 when the battery 67 runs out. This enables the controller 80 to determine whether the clock is in an off state depending on whether the power-loss flag information is stored in the flash memory 84.

Unlike this embodiment, if the recovery operation is performed immediately after a determination signal, which is output during the inspection driving, indicates a defective nozzle and the time interval between the inspection driving and receipt of a recording instruction is increased, the liquid in the inkjet head 4 may be thickened. In this case, the recovery operation would be necessarily performed when the recording instruction is received. This would eventually lead to wasteful discharge of ink at the recovery operation performed immediately after the inspection driving.

In this embodiment, however, when a determination signal output during the inspection driving indicates a defective nozzle, the flash memory 84 is used to store the recovery flag information. When an initial recording instruction is received only after the inspection driving and the recovery flag information is stored in the flash memory 84, a recovery operation is performed. This eliminates needless ink discharge described above even if the period of time between the inspection driving and receiving of the initial recording instruction is long.

In this embodiment, when a determination signal output during the inspection driving indicates a defective nozzle, flushing, which is a part of the recovery operation, is performed immediately after the inspection driving. Then, when the initial recording instruction is received only after the inspection driving, suction purging, which is a remaining part of the recovery operation is performed before the recording process. This can reduce the time it takes to perform the recovery operation before the recording process.

Modifications

While the disclosure has been described in detail with reference to the specific embodiment thereof, this is merely an example, and various changes, arrangements and modifications may be applied therein without departing from the spirit and scope of the disclosure.

In the above-described embodiment, when the power-loss flag information is stored in the flash memory 84 (S201: YES) and the temporary time indicated by the clock 68 becomes the second time (S203: YES), the steps S205 to S208 are performed. In some embodiments, these steps may be omitted or different steps may be performed.

Figure 7:
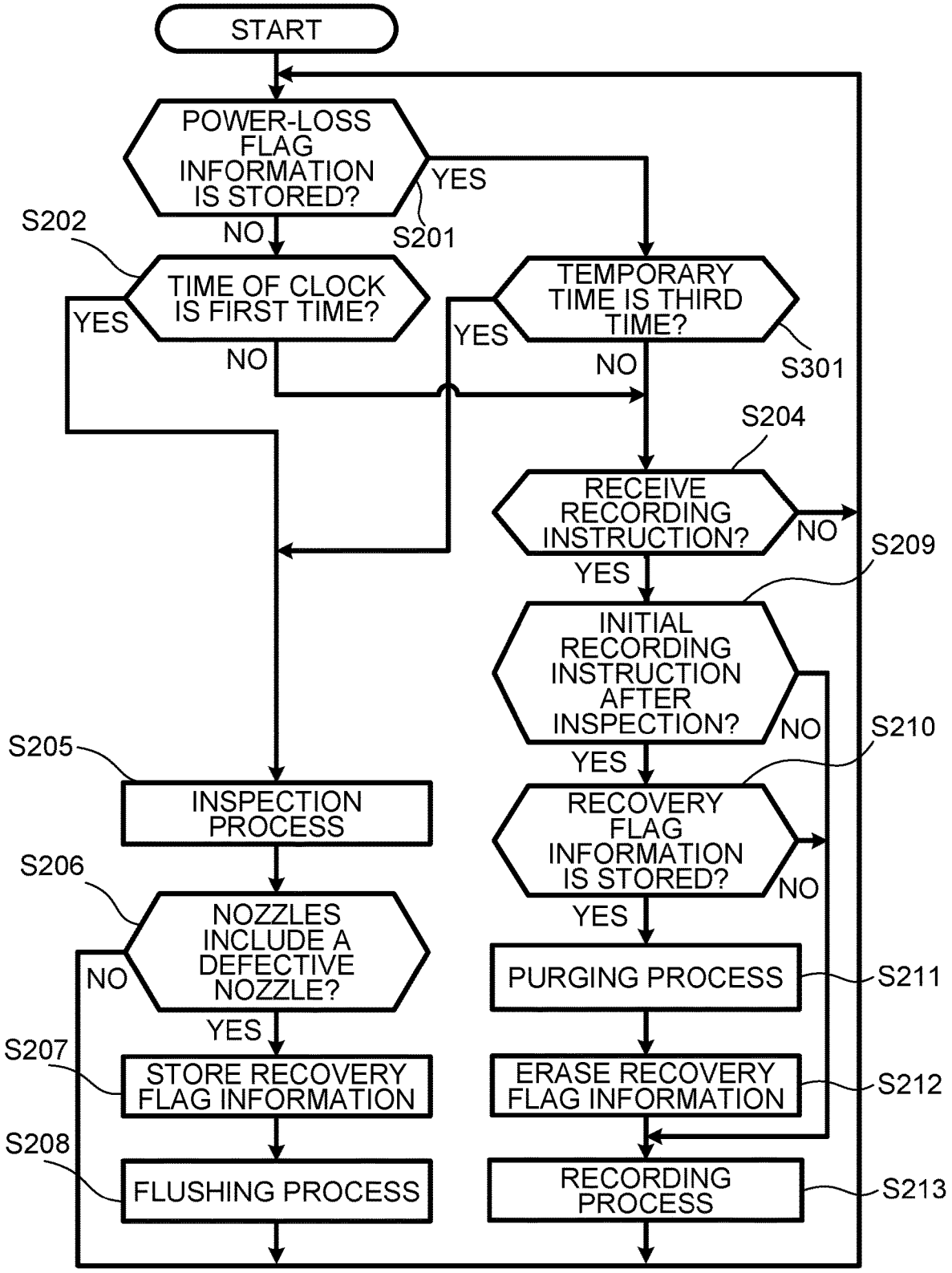
FIG. 7 is a flowchart according to a first modification, corresponding to FIG. 6.

In a first modification, the controller 80 performs a process in accordance with the flowchart of FIG. 7 instead of the process in accordance with the flowchart of FIG. 6 of the above-described embodiment. The process of FIG. 7 is obtained by replacing S203 in the flowchart of FIG. 6 with S301.

In S301, the controller 80 determines whether the temporary time indicated by the clock 68 is a third time that is earlier than the second time. The third time is time for the controller 80 to perform the inspection process, and is stored in advance in the flash memory 84. If the temporary time indicated by the clock 68 is not the third time (S301: NO), the process proceeds to S204. In response to determining that the temporary time indicated by the clock 68 is the third time (S301: YES), the controller 80 performs steps S205 to S208.

In the first modification, if the clock 68 is in an off state when power is turned on, the controller 80 assumes the time at which the power is turned on as the second time and causes the clock 68 to measure a temporary time. Thereafter, the controller 80 performs the inspection process every time the temporary time indicated by the clock 68 is the third time, which is earlier than the second time, of next and subsequent days until the battery 67 runs out. The controller 80 thus performs the inspection process periodically even if the clock 68 has been switched to an off state. Normally, the user turns on the power of the printer when using the printer. Probably, the user will not use the printer between the second time and the third time that is earlier than the second time. Thus, the inspection process can be performed when the temporary time indicated by the clock 68 is the third time before the second time.

In this embodiment and the first modification, when the clock 68 returns from an off state to an on state, time to perform the inspection process is returned to time at which the time the clock 68 indicates is the first time. However, the inspection process may be performed at a different time from the above. For example, even after the clock 68, which was in an off state, returns to the on state in which it keeps actual time, the inspection process may be performed at time different from the first time, such as the second time or the third time.

Further, the present invention is not limited to a configuration in which, when the clock 68 is in an off state, the clock 68 is caused to measure a temporary time and an inspection process is performed based on the temporary time.

Figure 8:
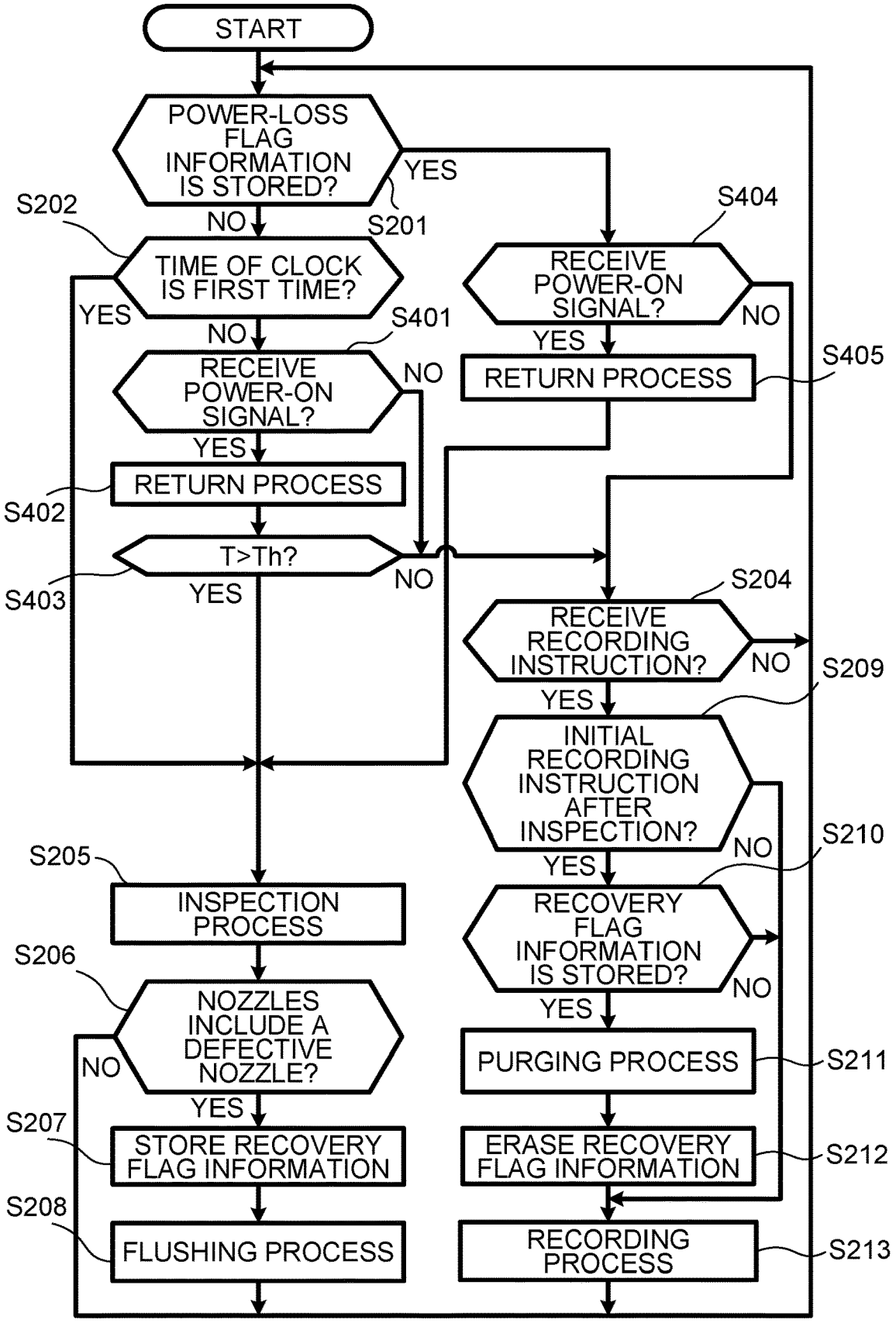
FIG. 8 is a flowchart according to a second modification, corresponding to FIG. 6.

In a second modification, the controller 80 performs a process in accordance with the flowchart of FIG. 8 instead of the process in accordance with the flowchart of FIG. 6 of the above-described embodiment. In the process of FIG. 8, in response to determining that the power-loss flag information is not stored in the flash memory 84 (S201: NO) and that the time indicated by the clock 68 is not the first time (S202: NO), the controller 80 determines whether it has received a power-on signal in S401. If the controller 80 has not received the power-on signal (S401: NO), the process proceeds to S204.

In response to receipt of the power-on signal (S401: YES), the controller 80 performs a return process in S402. In the return process, the controller 80 controls at least some of the components of the printer 1 to perform a return operation for returning the printer 1 to a state in which recording on the recording sheet P is feasible. The return operation refers to, for example, an operation for adjusting an original positions of the carriage 2 or the cap 71.

In accordance with a time signal received from the clock 68, the controller 80 determines whether an elapsed time T from when the power of the printer 1 was turned off to when the power is turned on again is longer than a predetermined time Th in S403. If the elapsed time T is shorter than or equal to the predetermined time Th (S403: NO), the process proceeds to S204. When the elapsed time T is longer than the predetermined time Th (S403: YES), the process proceeds to S205.

In response to determining that the power-loss flag information is stored in the flash memory 84 (S201: YES), the controller 80 determines whether it has received a power-on signal in S404.

If the controller 80 has not received the power-on signal (S404: NO), the process proceeds to S204. In response to receipt of the power-on signal (S404: YES), the controller 80 performs a return process similar to that in S402 in S405, and the process proceeds to S205.

In the second modification, when the clock 68 is in an off state, the controller 80 performs the inspection process at a timing after the return operation when the power is turned on. When the battery becomes exhausted, the printer 1 cannot keep track of the elapsed time since the power was turned off. In the second modification, however, the inspection process is performed at a timing after the return operation. The printer 1 can thus keep track of whether a nozzle 10 is defective, and subsequently perform the recovery operation only when necessary. This reduces or eliminates unnecessary consumption of ink.

In the second modification, the inspection process is performed at a time after the return operation. In some embodiments, the inspection process may be performed at a different timing. In the second modification, the inspection process may be performed at a time within a period from when the power is turned on to when the return operation is started, for example, immediately before S402 or S405 is started.

Figure 9:
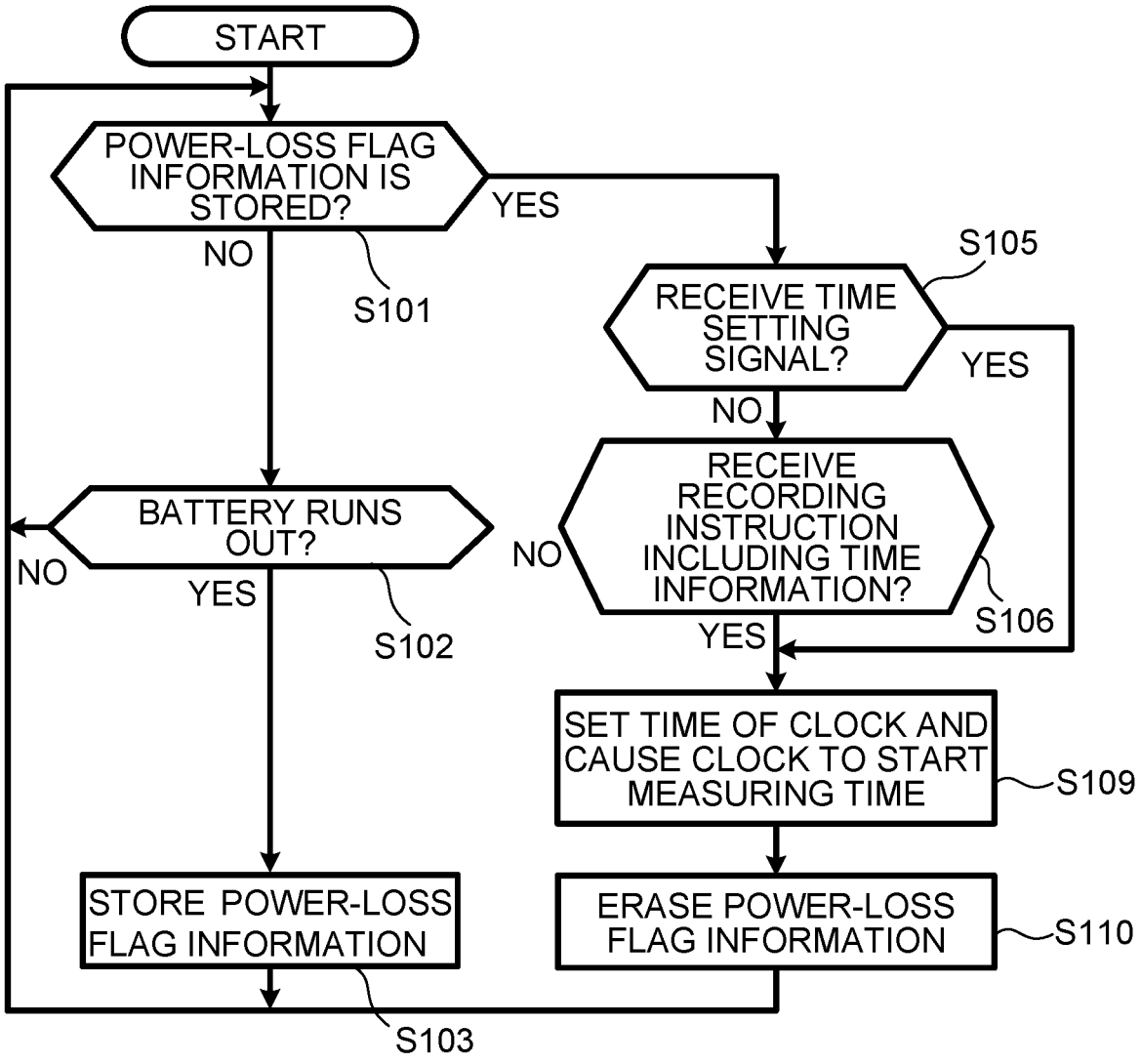
FIG. 9 is a flowchart according to a third modification, corresponding to FIG. 5.
Figure 10:
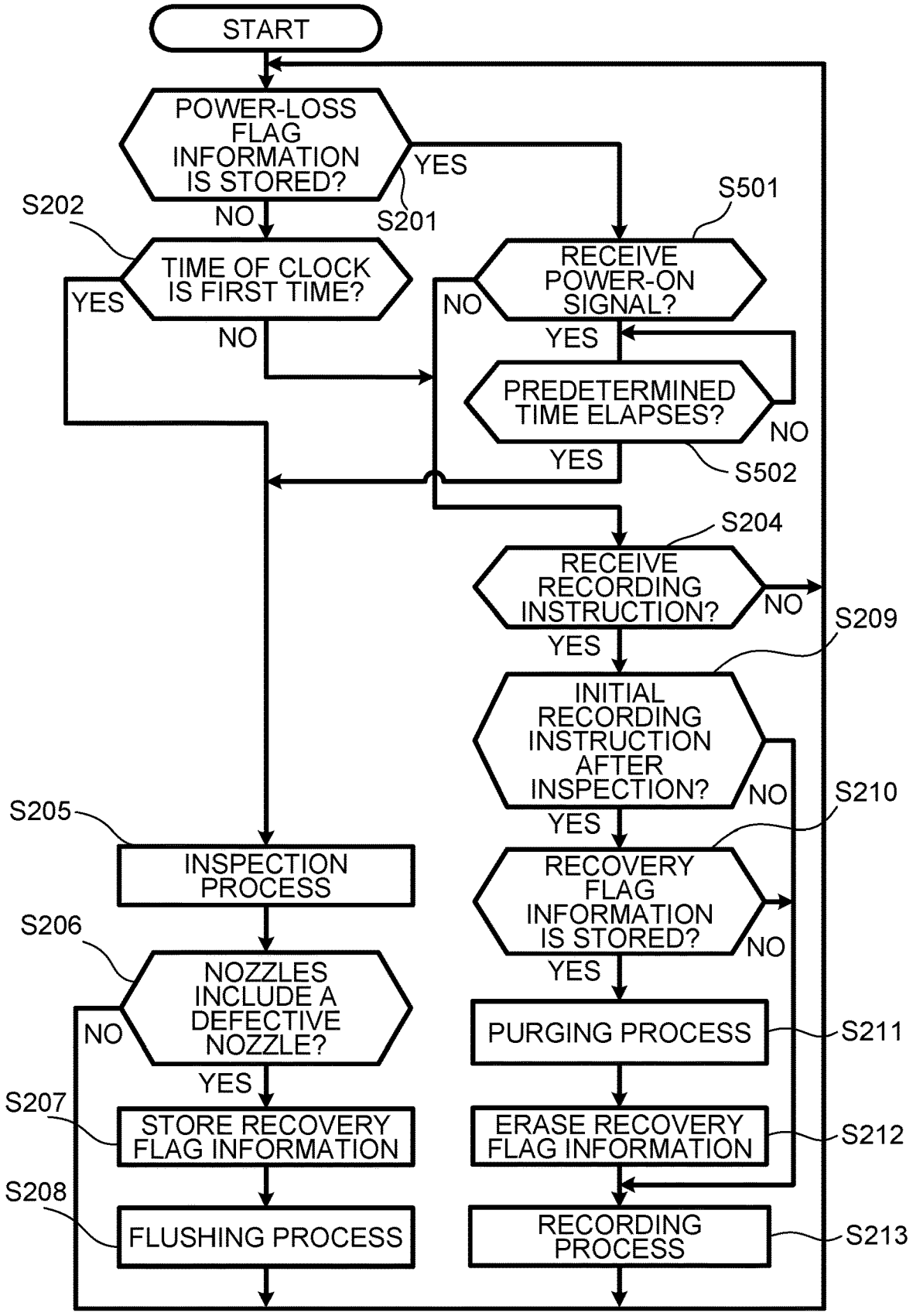
FIG. 10 is a flowchart according to the third modification, corresponding to FIG. 6.

In a third modification, the controller 80 performs a process in accordance with the flowchart of FIG. 9 or 10 instead of the process in accordance with the flowchart of FIG. 5 or 6 of the above-described embodiment.

The process of FIG. 9 does not include steps S104, S107, and S108 of the process of FIG. 5. When the controller 80 determines that the power-loss flap information is stored in the flash memory 84 in S101 (S101: YES), the process proceeds to S105.

In the process of FIG. 10, in response to determining that the power-loss flag information is stored in the flash memory 84 (S201: YES), the controller 80 determines whether it has received a power-on signal in S501.

If the controller 80 has not received the power-on signal (S501: NO), the process proceeds to S204. In response to receipt of the power-on signal (S501: YES), the controller 80 waits until a predetermined time elapses (S502: NO), and when the predetermined time has elapsed (S502: YES), the process proceeds to S205.

In the third modification, even if the clock 68 is in an off state, the controller 80 performs the inspection process at the conclusion of a predetermined time elapsed since the power was turned on. The user is likely to use the printer immediately after the power is turned on, whereas, as described in the third modification, the user is unlikely to use the printer after a predetermined time elapsed since the power was turned on. Thus, the inspection process may be performed at the timing when the predetermined time has elapsed since the power was turned on.

Figure 11:
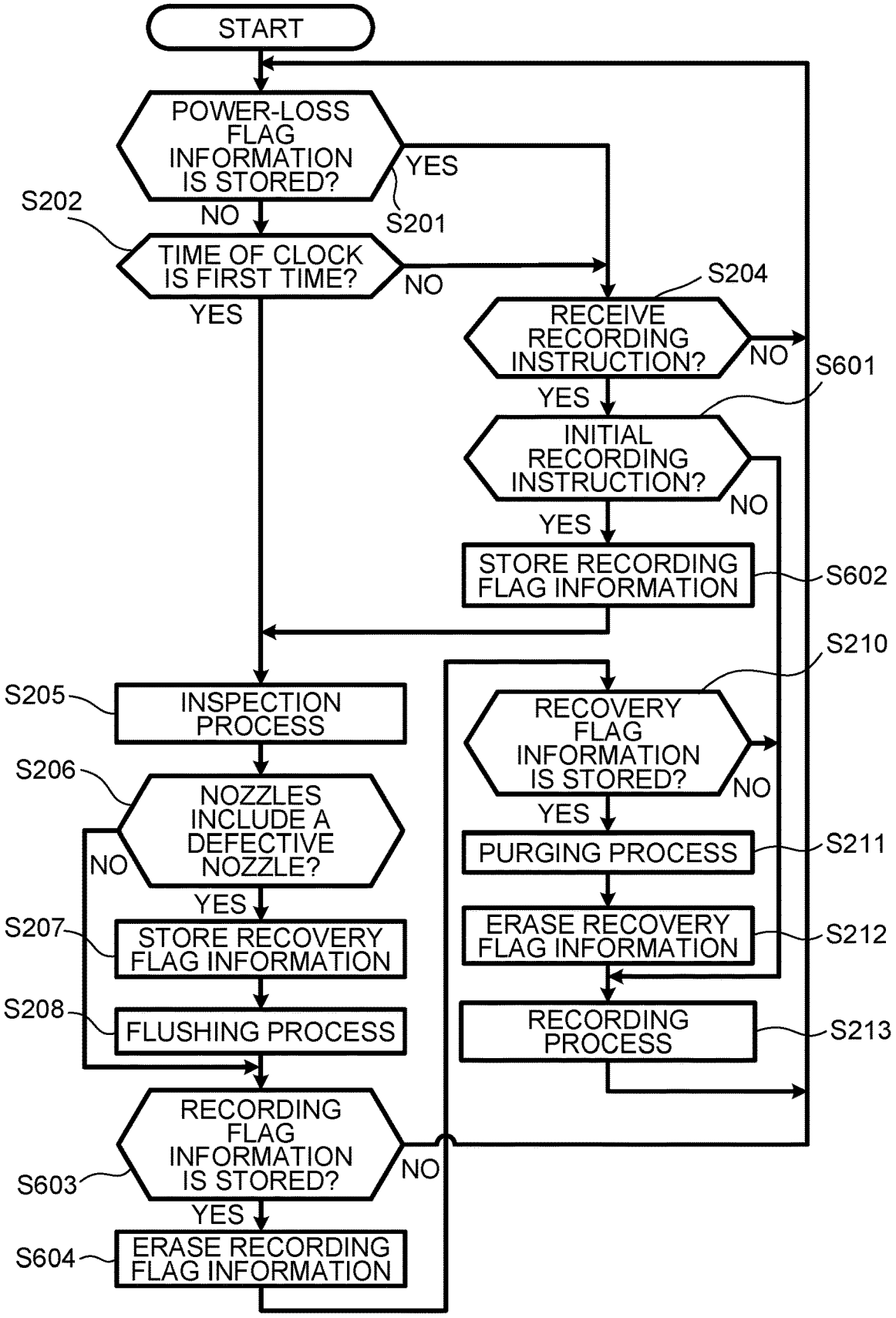
FIG. 11 is a flowchart according to a fourth modification, corresponding to FIG. 6.

In a fourth modification, the controller 80 performs a process in accordance with the flowchart of FIG. 11 instead of the process in accordance with the flowchart of FIG. 6 of the above-described embodiment.

In the process of FIG. 11, when the power-loss flag information is stored in the flash memory 84 (S201: YES) or is not stored in the flash memory 84 (S201: NO) and the time indicated by the clock 68 is not the first time (S202: NO), the process proceeds to S204.

In S204, when the controller 80 determines that the recording instruction has not been received (S204: NO), the process returns to S201. In response to determining that the recording instruction has been received in the S204 (S204: YES), the controller 80 determines whether the received recording instruction is an initial recording instruction received only after receipt of the power-on signal in S601. Here, "an initial recording instruction received only after receipt of the power-on signal" refers to a recording instruction received only after the power supply of the printer 1 is turned on with the clock 68 losing time.

If the received recording instruction is not an initial recording instruction received only after receipt of the power-on signal (S601: NO), the process proceeds to S213. When the received recording instruction is an initial recording instruction received only after receipt of the power-on signal (S601: YES), the controller 80 stores, in the flash memory 84, recording flag information indicating that recording is to be performed in S602, and the process proceeds to S205.

In the fourth modification, when it is determined that the nozzles do not include a defective nozzle in S206 (S206: NO) or after the flushing process is performed in S208, the controller 80 determines whether the recording flag information is stored in the flash memory 84 in S603. When the recording flag information is not stored in the flash memory 84 (S603: NO), the process returns to S201. In response to determining that the recording flag information is stored in the flash memory 84 (S603: YES), the controller 80 erases the recording flag information stored in the flash memory 84 in S604, and then the process proceeds to S210.

In the fourth modification, even when the clock 68 is in an off state, the controller 80 performs the inspection process before image recording on a sheet P only after the power is turned on.

In the above embodiment, when a determination signal output from the determination circuit 78 during the inspection driving indicates a defective nozzle, flushing, which is a part of the recovery operation, is performed. In response to a receipt of a recording instruction only after the inspection driving, suction purging is performed as a remaining part of the recovery operation. However, the timing to perform suction purging is not limited to the above.

For example, the printer 1 may be selectable between recording with low image quality and recording with high image quality, and perform steps S210 to S213 upon receiving a recording instruction to perform recording with high image quality only after the inspection driving.

Suction purging, which is a remaining part of the recovery operation, may be performed except when a recording instruction is received. For example, suction purging may be performed when a specified signal except for a recording instruction is received.

The recovery operation is not limited to the combination of flushing and suction purge.

For example, the recovery operation may be suction purge. When a detection signal output from the determination circuit 78 during the inspection driving indicates a defective nozzle, suction purge may be performed as a part of the recovery operation. Thereafter, when a predetermined signal is received, suction purging may be performed as a remaining part of the recovery operation.

Alternatively, for example, the recovery operation may be flushing. When a detection signal output from the determination circuit 78 during the inspection driving indicates a defective nozzle, flushing may be performed as a part of the recovery operation. Thereafter, when a predetermined signal is received, flushing may be performed as a remaining part of the recovery operation.

When a determination signal output from the determination circuit 78 during the inspection driving indicates a defective nozzle, maintenance is not limited to performing a part of the recovery operation. When a predetermined signal is received, maintenance is not limited to performing a remaining part of the recovery operation.

For example, when a detection signal output from the determination circuit 78 during the inspection driving indicates a defective nozzle, the recovery operation may not be performed. Thereafter, when a predetermined signal is received, the entire recovery operation may be performed.

Alternatively, for example, when a detection signal output from the determination circuit 78 during the inspection driving indicates a defective nozzle, the entire recovery operation may be performed immediately. Thereafter, when a predetermined signal is received, the recovery operation may not be performed.

In the above-described embodiment, the inspection driving is performed for each of the nozzles 10 of the inkjet head 4. For example, inspection driving may be performed only for some of the nozzles 10 of the inkjet head 4, such as every other nozzle 10 in each nozzle row 9. Remaining nozzles 10 may be estimated as to whether or not a nozzle is defective based on the determination signal output from the determination circuit 78 during the inspection driving.

The above-described embodiment shows, but is not limited to, that the determination circuit 78 outputs a signal responsive to whether a nozzle 10 is defective in accordance with a potential of the detection electrode 76 when ink is ejected from the nozzle 10 toward the detection electrode 76. However, ink ejected from the nozzle 10 may not be directed toward the detection electrode 76.

For example, instead of the detection electrode 76, a detection electrode elongated vertically may be disposed such that ink ejected from the nozzle 10 may pass an area parallel to the elongated detection electrode, and a signal responsive to whether a nozzle is a defective nozzle may be output from the determination circuit. Alternatively, an optical sensor may be disposed to detect ink ejected from a nozzle 10, and the determination circuit is configured to output a signal responsive to whether a nozzle is a defective nozzle based on a signal from the optical sensor.

Alternatively, a known technique for outputting a determination signal may be adopted. For example, a printer may include a voltage detection circuit connected to a nozzle plate of an inkjet head. In response to the inkjet head being driven for ejecting ink from a nozzle, the voltage detection circuit may detect changes in voltage at the voltage detection circuit and output a signal responsive to whether the nozzle is a defective nozzle to the controller 80. The voltage detection circuit is another example of the determination circuit.

Alternatively, another known technique for outputting a determination signal may be adopted. For example, a substrate of an inkjet head may include a temperature detection element. In such a case, a first voltage may be applied to a heater to allow the inkjet head to eject ink from a nozzle. Then, a second voltage may be applied to the heater to prevent the inkjet head from ejecting ink from the nozzle. The determination circuit will output a signal responsive to whether the nozzle 10 is a defective nozzle based on changes in temperature detected by the temperature detection element during a certain time period since the application of the second voltage.

In the above embodiment and modifications, a nozzle 10 from which ink is not ejected is determined as a defective nozzle. However, a defective nozzle is not limited to such a nozzle. For example, a determination circuit may be used to output a signal responsive to whether ink is ejected from a nozzle 10 in an intended direction. Based on the signal, a nozzle 10 from which ink is ejected in an unintended direction may be determined as a defective nozzle.

In the above-described embodiment, suction purging for discharging a predetermined amount of ink is performed in the purging process. However, purging is not limited to suction purging. For example, the maintenance unit 8 may be configured to selectively perform any one of a plurality of types of suction purging each for discharging a different amount of ink. The plurality of types of suction purging may each have a different amount of ink to be discharged, for example, by changing at least one of the driving time or the rotation speed of the suction pump 72. In the purging process, for example, suction purging may be performed with larger amount of ink to be discharged the number of defective nozzles is.

In the above description, suction purging is performed in the purging process. However, the purging process is not limited to suction purging. For example, a booster pump may be disposed in portions of the tubes 15 connecting the sub tank 3 and the ink cartridges 14. Alternatively, the printer may include the booster pump to be connected to the ink cartridges. The booster pump may be driven with the nozzles 10 covered by the cap 71 to increase the pressure of ink in the inkjet head 4, thereby causing the inkjet head 4 to discharge ink from the nozzles 10. This is what is called pressurized purging.

Alternatively, both of suction by the suction pump 72 and pressurization by the booster pump may be performed in the purging process.

In the above-described examples, the printer includes the battery that supplies power to the clock, and the clock stops keeping the actual time when the power supply from the plug to the printer is stopped and the battery runs out. In some embodiments, for example, the printer may not include a battery that supplies power to the clock. In this case, the clock may stop keeping the actual time when the supply of power from the plug to the printer is stopped.

The disclosure has been applied to a printer including a serial head that moves in the scanning direction together with a carriage. However, the disclosure may also be applied to a printer including, for example, a line head extending over the entire length of a recording sheet P in the scanning direction.

The disclosure has been applied to a printer that ejects ink from nozzles to record an image on a recording sheet P. However, the disclosure may also be applied to another printer that may record an image on a recording medium other than a recording sheet. Examples of the recording media include a T-shirt, a sheet for outdoor advertisement, a casing of a mobile terminal such as a smartphone, a cardboard, and a resin member. Further, the disclosure may also be applied to a liquid ejection apparatus that may eject liquid other than ink such as liquid resin or liquid metal.

What is claimed is:

1. A liquid ejection apparatus comprising:

a liquid ejection head having a plurality of nozzles;

a circuit configured to output a determination signal in response to ejection of liquid from a nozzle of the plurality of nozzles, the determination signal indicating whether the nozzle is a defective nozzle;

a clock configured to measure time and to keep actual time; and a controller configured to:

determine whether the clock is in an on or off state in response to determining that the clock is in an on state, perform an inspection process at a first time, wherein, in the inspection process, the controller is configured to drive the liquid ejection head to eject liquid from the nozzle of the plurality nozzles and receive a determination signal that is output from the circuit in response to ejection of liquid from the nozzle of the plurality of nozzles;

in response to determining that the clock is in an off state, perform the inspection process at a predetermined time that is a time after the clock is returned to an on state.

2. The liquid ejection apparatus according to claim 1, further comprising:

a plug;

a battery configured to supply the clock with power; and storage, wherein the controller is configured to:

store power-loss flag information in the storage, the power-loss flag information indicating that the clock is in the off state;

determine whether the power-loss information is stored in the storage in response to power being supplied from the plug to the liquid ejection apparatus;

in response to determining that the power-loss flag information is not stored in the storage, determine that the clock keeps time and perform the inspection process when the time the clock indicates is the first time;

in response to determining that the power-loss flag information is stored in the storage, perform the inspection process at the predetermined time.

3. The liquid ejection apparatus according to claim 1, wherein the controller is configured to, in response to determining that the clock is in an off state time when the liquid ejection apparatus is turned on, cause the clock to start measuring a temporary time from a second time that is time when the liquid ejection apparatus is turned on, and wherein the predetermined time is time when the temporary time the clock indicates is the same time of day as the second time on next and subsequent days.

4. The liquid ejection apparatus according to claim 1, wherein the controller is configured to, in response to determining that the clock is in an off state when the liquid ejection apparatus is turned on, cause the clock to start measuring a temporary time from a second time that is time when the liquid ejection apparatus is turned on, and wherein the predetermined time is time when the temporary time the clock indicates is a third time, the third time being earlier than the second time on next and subsequent days.

5. The liquid ejection apparatus according to claim 1, wherein the controller is configured to cause the liquid ejection head to perform a return operation when the liquid ejection apparatus is turned on, and wherein the predetermined time is time immediately after the return operation.

6. The liquid ejection apparatus according to claim 1, wherein the predetermined time is time elapsed after the liquid ejection apparatus is turned on.

7. The liquid ejection apparatus according to claim 1, wherein the controller is configured to, in response to reception of an ejection instruction signal, cause the liquid ejection head to eject liquid from the nozzles toward a recording medium, and wherein the predetermined time is time immediately before the controller causes the liquid ejection head to eject liquid from the nozzles toward a recording medium based on the ejection instruction signal only after the liquid ejection apparatus is turned on.

8. The liquid ejection apparatus according to claim 1, further comprising:

a pump for performing a recovery operation to discharge liquid from the nozzles; and storage, wherein the controller is configured to, in response to receiving the determination signal indicating that the nozzle is a defective nozzle from the circuit, store recovery flag information in the storage, the recovery flag information indicating a need to perform the recovery operation, in response to receiving a predetermined signal, determine whether the recovery flag information is stored in the storage, and in response to determining that the recovery flag information is stored in the storage, cause the pump to perform the recovery operation.

9. The liquid ejection apparatus according to claim 8, wherein the predetermined signal is an ejection instruction signal, wherein the controller is configured to, in response to receiving the ejection instruction signal and determining that the recovery flag information is stored in the storage, cause the pump to perform the recovery operation and cause the liquid ejection head to eject liquid from the nozzles toward the recording medium.

10. The liquid ejection apparatus according to claim 9, wherein the predetermined signal is the ejection instruction signal received only after the inspection process.

11. The liquid ejection apparatus according to claim 8, wherein the pump is connectable to the liquid ejection head, and wherein the recovery operation includes purging to discharge liquid in the ejection liquid head from the nozzles by driving the pump.

12. The liquid ejection apparatus according to claim 1, further comprising:

a pump for performing a recovery operation to discharge liquid from the nozzles; and storage, wherein the controller is configured to, in response to receiving the determination signal indicating that the nozzle is a defective nozzle from the circuit, store recovery flag information indicating a need to perform the recovery operation in the storage, and cause the pump to perform a part of the recovery operation, in response to receiving a predetermined signal, determine whether the recovery flag information is stored in the storage, and in response to determining that the recovery flag information is stored in the storage, cause the pump to perform a remaining part of the recovery operation.

13. The liquid ejection apparatus according to claim 12, wherein the recovery operation includes flushing to discharge liquid in the liquid ejection head from the nozzles by driving the liquid ejection head.

14. The liquid ejection apparatus according to claim 12, wherein the pump is connectable to the liquid ejection head, wherein the part of the recovery operation is flushing to discharge liquid in the liquid ejection head from the nozzles by driving the liquid ejection head, and wherein the remaining part of the recovery operation is purging to discharge liquid in the ejection liquid head from the nozzles by driving the pump.

* * * * *